United States Patent [19]

Steinkühler et al.

[11] Patent Number: 4,646,449

[45] Date of Patent: Mar. 3, 1987

[54] BUCKET WHEEL DREDGING DEVICE

[75] Inventors: Siegfried Steinkühler, Bad Schwartau; Ulrich Wäntig, Lubeck, both of Fed. Rep. of Germany

[73] Assignee: O & K Orenstein & Koppel Aktiengesellschaft, Fed. Rep. of Germany

[21] Appl. No.: 754,866

[22] Filed: Jul. 12, 1985

[30] Foreign Application Priority Data

Jul. 17, 1984 [DE] Fed. Rep. of Germany ..... 3426328

[51] Int. Cl.[4] ..... E02F 3/92

[52] U.S. Cl. ..... 37/66

[58] Field of Search ..... 37/66, 58

[56] References Cited

U.S. PATENT DOCUMENTS

| | | | |
|---|---|---|---|
| 477,827 | 6/1892 | Souther | 37/58 |
| 548,242 | 10/1895 | Wood et al. | 37/58 |
| 595,054 | 12/1897 | Flad | 37/58 |
| 4,058,914 | 11/1977 | Kiss | 37/66 |
| 4,227,323 | 10/1980 | Quigg et al. | 37/58 |
| 4,242,814 | 1/1981 | Fluks | 37/66 |
| 4,302,893 | 12/1981 | Van den Elshout et al. | 37/66 |

FOREIGN PATENT DOCUMENTS

| | | | |
|---|---|---|---|
| 473767 | 3/1929 | Fed. Rep. of Germany | 37/66 |
| 1484781 | 4/1969 | Fed. Rep. of Germany | 37/66 |
| 23441 | 6/1976 | Japan | 37/66 |
| 7812140 | 6/1980 | Netherlands | 37/66 |

*Primary Examiner*—Clifford D. Crowder

*Attorney, Agent, or Firm*—McGlew and Tuttle

[57] ABSTRACT

A bucket wheel cutting device with two cutting wheels for a floating dredge with suction tube conveyance, has its suction tube arranged to end in two suction chambers separated by a central partition, one of the cutting wheels being provided at each of the two sides thereof. The suction chambers can be closed alternately, relative to the suction tube, by means of an adjustable flap.

2 Claims, 2 Drawing Figures

BUCKET WHEEL DREDGING DEVICE

FIELD AND BACKGROUND OF THE INVENTION

The present invention relates to a bucket wheel cutting device with two cutting wheels for a floating dredge with suction tube conveyance.

A conveying device for a floating suction dredge, to whose suction tube two bucket wheels are attached, is already known from German OS No. 1,484,781.

In one such conveying device, however, the bottom being cut (dredged) by the cutting wheels is only partially captured and carried away by the suction stream of the dredging pump.

SUMMARY OF THE INVENTION

An object of the present invention resides in providing a bucket wheel cutting device in which it is assured that the excavated material being cut is carried away at a high volume efficiency.

Toward this end the invention provides a device as set forth above wherein the suction tube has an end with two suction chambers separated by a central partition, one of the cutting wheels being provided at each of the two sides thereof, and which suction chambers can be closed alternately, relative to the suction tube, by means of an adjustable flap. Here the suction chambers are provided predominantly in the lower region of the cutting wheels, and these have cutting openings at their sides.

Characteristic advantages are achieved by the solution of the problem in accordance with the invention, in the operation of the bucket wheel dredge, in terms of constant and unequivocal cutting conditions, and a constant, highly efficient removal of the excavated material can be assured. The material loosened by the cutting is sucked away directly through the cutting openings. Because of the ability to block off the other suction chamber associated with the cutting wheel that is not removing material, the suction and transporting of additional water is prevented.

Accordingly a further object of the invention is to provide a bucket wheel cutting device for a floating dredge which comprises support structure that carries a suction tube having an end portion, a pair of cutting wheels which are mounted for common rotation on opposite sides of the end portion of the tube, a tube containing a partition for dividing the end portion into two opposite chambers each associated with one of the cutting wheels, and a flap movable in the suction tube for alternately establishing communication between one of the chambers and a remainder of suction tube.

A further object of the invention is to provide a bucket wheel cutting device which is simple in design, rugged in construction and economical to manufacture.

The various features of novetly which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE PREFERRED EMBODIMENT

Figure 1:
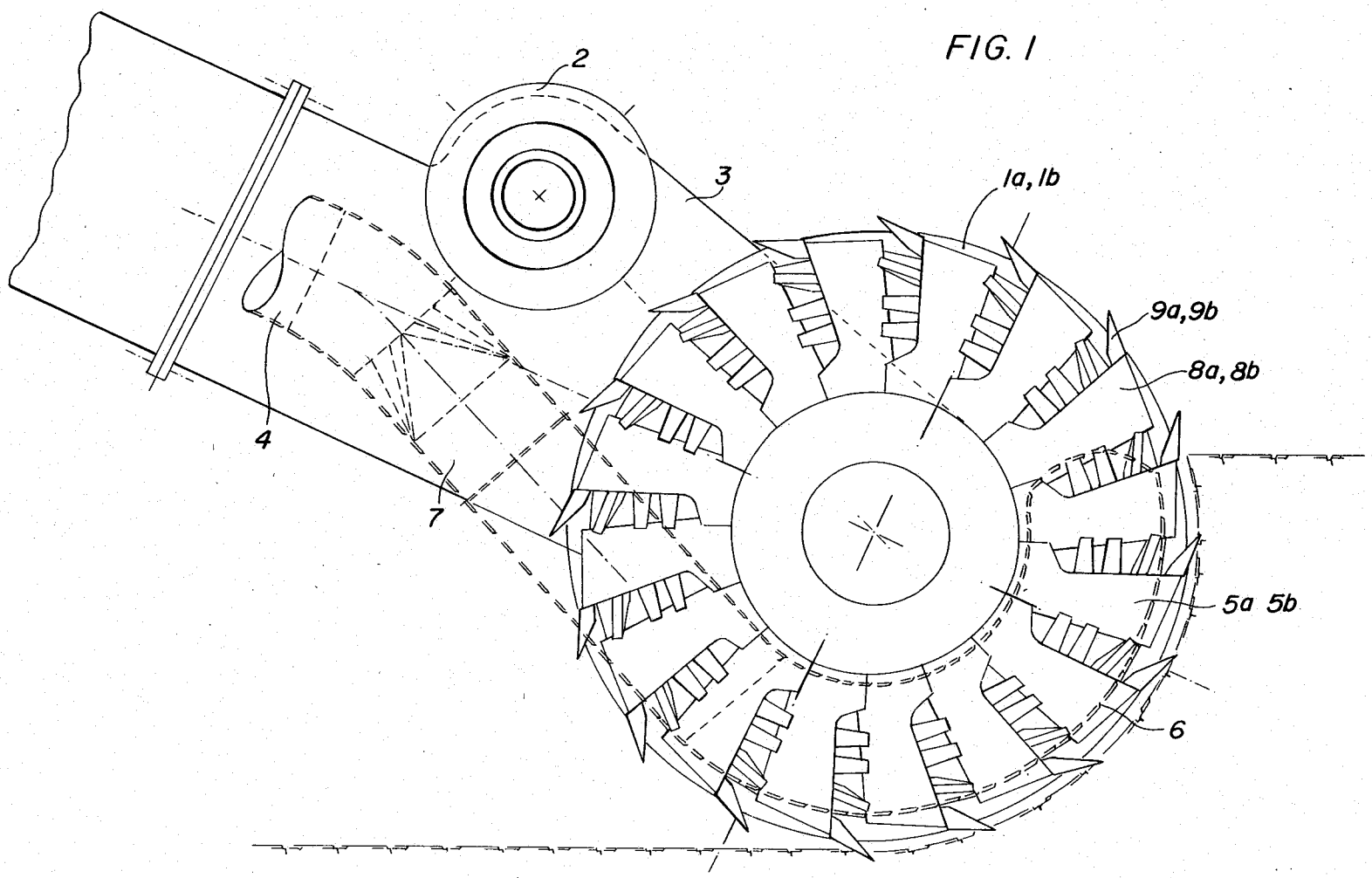
FIG. 1 is a side elevational view of the bucket wheel cutting device.

According to FIG. 1, the inventive bucket wheel device has two cutting wheels 1*a* and 1*b*, which are commonly driven hydraulically by a hydrometer 2, incorporated into the support structure of a suction tube boom, together with a transmission 3. A suction tube 4 ends in two suction chambers 5*a* and 5*b*, provided within the centrally arranged wheel support. These chambers are separated by a central partition 6 (also see FIG. 2). An adjustable flap 7 is provided, which connects only one of the suction chambers 5*a* or 5*b* with the suction tube 4, this chamber being associated with the conveying cutting wheel 1*a* or 1*b*, depending on the direction of pivoting of the suction tube boom during the dredging operations. Each of the suction chambers is bounded not only by the central partition 6, but also by the mechanical support structure and a skimmer (not shown).

Cutting brackets 8*a* and 8*b*, fitted respectively with cutting knives 9*a* and 9*b*, expose cutting openings at the sides which provide for intake of the excavated material into the suction chambers. It can also be seen from the figures that suction chambers 5*a* and 5*b* are provided predominantly in the lower region of cutting wheels 1*a* and 1*b*, i.e. directly behind the bottom bed of the waterway which is to be cut away.

Figure 2:
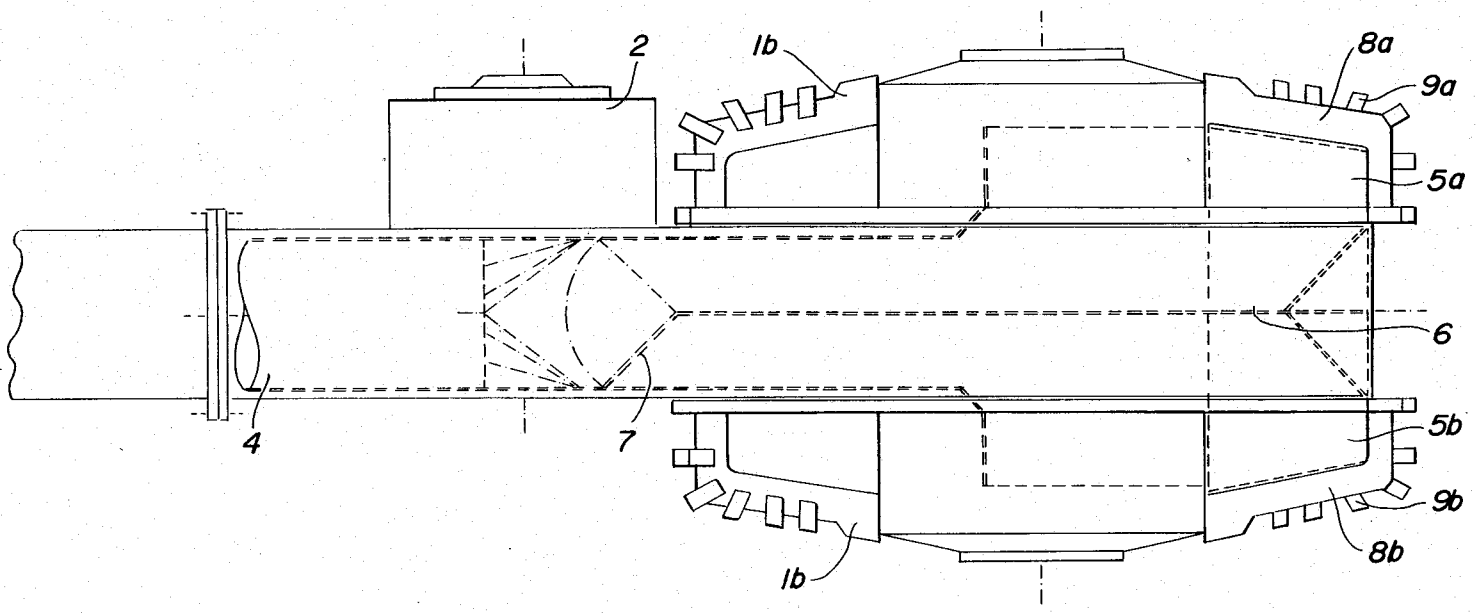
FIG. 2 is a bottom plan view of the device of FIG. 1.

The chambers 5*a*, 5*b* wheel support as shown in FIG. 1, and are elongated in the axial direction of the tube 4 and its boom, as is the partition 6. As also shown in FIG. 2, each chamber 5*a*,5*b* is open to the side and thus to its cutting wheel, at a location spaced from flap 7. The chambers are closed to the side near the flap.

FIG. 2 indicates the reference numbers given for the corresponding mechanical components.

By means of the bucket wheel cutting device elucidated above, it is possible to carry out extensive dredging operations which serve for maintaining and enlarging underwater structures. Because it is easily possible to pivot the suction tube boom laterally, thus sweeping out a working area to one side and the other, with excavation of large quantities of material, it becomes easy to steer the accompanying floating dredge, and in particular to achieve unequivocal positioning. In addition, it is possible with such a device to collect raw materials under water. This is true even in those cases where the excavated material must be loosened mechanically with a considerable consumption of energy.

The invention is a bucket wheel cutting device for a floating dredge comprising a suction tube 4 having an end with two suction chambers 5*a*, 5*b*, for material to be dredged and a partition 6 for separating the chambers, a cutting wheel 1*a*, 1*b* provided at each of two sides of the suction tube end, each cooperating with one of said suction chambers and a flap 7 movable in said tube end for alternately closing communication between said two chambers and a remainder of said suction tube 4.

While a specific embodiment of the invention has been shown and described in detail to illustrate the application of the principles of the invention, it will be understood that the invention may be embodied otherwise without departing from such principles.

What is claimed is:

1. A bucket wheel cutting device for a suction dredge comprising:

a suction tube boom having an end;

a support connected to said end of said boom;

a pair of spaced apart connected together cutting wheels rotatably mounted to said support on opposite sides of said support, each wheel having side openings for receiving material to be dredged;

drive means connected to said connected together cutting wheels for rotating said cutting wheels on said support;

a suction tube defining a suction space and having a lower end disposed between said cutting wheels, a partition in said lower end dividing said lower end into two suction chambers each facing one of said cutting wheels and for receiving material dredged by each cutting wheel respectively, said suction tube being supported by said suction tube boom and extending in an axial direction along said boom, said partition and said two suction chambers being elongated in said axial direction and being disposed in a lower area of said support between said cutting wheels and between lower areas of said cutting wheels for receiving material entering said side openings of said cutting wheels; and a flap movably mounted in said suction tube from a first position blocking communication between one of said chambers and said tube space and opening communication between the other of said chambers and said tube space, and an opposite position establishing communication between said first mentioned chamber and said tube space and closing communication between said other chamber and said tube space, said flap being positioned in said boom at a location spaced from said support.

2. A bucket wheel cutting device according to claim 1, wherein said support has a circular outer contour, each of said two suction chambers having a curved shape following said circular contour in the lower area of said support, each of said two suction chambers being open to their respective cutting wheels at a location spaced from said flap, each of said two suctions chambers having a portion which is closed to the side and with respect to its cutting wheel at a location near said flap.

* * * * *